United States Patent [19]

Linkous

[11] Patent Number: 4,737,393

[45] Date of Patent: Apr. 12, 1988

[54] DUAL PERFORATION OF SCRIM-REINFORCED WEBS

[75] Inventor: Jeffery A. Linkous, Corinth, Miss.

[73] Assignee: Kimberly-Clark Corporation, Neenah, Wis.

[21] Appl. No.: 57,408

[22] Filed: Jun. 2, 1987

[51] Int. Cl.[4] ..... B65D 65/28

[52] U.S. Cl. ..... 428/43; 428/105; 428/107; 428/109; 428/131; 428/136; 428/137; 428/224; 428/284

[58] Field of Search ..... 428/43, 105, 107, 109, 428/131, 136, 137, 138, 224, 284

[56] References Cited

U.S. PATENT DOCUMENTS

| | | | |
|---|---|---|---|
| 3,205,750 | 9/1965 | Strange | 83/660 |
| 3,255,648 | 6/1966 | Buttery | 83/9 |
| 3,268,136 | 8/1966 | Huffman | 225/2 |
| 3,716,132 | 2/1973 | Lewyckyj | 206/58 |
| 3,835,754 | 9/1974 | Lewyckyj | 93/1 |

*Primary Examiner*—James J. Bell

*Attorney, Agent, or Firm*—William D. Herrick

[57] ABSTRACT

There is disclosed a scrim-reinforced web which is divided into individual sheets by a perforation pattern across the web. In order to insure all scrim filaments running lengthwise are severed, a dual perforation pattern is used. The dual perforation pattern has a primary perforation pattern with alternating, unsevered primary bond portions and primary perforations and a secondary perforation pattern with unsevered secondary bond portions and secondary perforations. The secondary perforations are spaced lengthwise from the primary perforation pattern, are aligned with, and overlap the unsevered primary bond portions.

1 Claim, 2 Drawing Sheets

DUAL PERFORATION OF SCRIM-REINFORCED WEBS

BACKGROUND OF THE INVENTION

This invention relates generally to perforating a web in the cross machine direction, and more particularly concerns dual perforation of scrim-reinforced webs to assure that all scrim filaments running in the machine direction are severed during perforation.

Nonwoven fabrics, such as melt-blown fabrics and spun-bonded fabrics, are frequently used as wipers in medical, commercial, and household applications. Such nonwoven material, while having excellent characteristics as wipers in terms of absorbency, linting, handling characteristics, and cost, frequently lack requisite tensile strength. In order to overcome the tensile strength deficiencies of nonwoven fabrics, the nonwoven fabric is sometimes laminated on either side of a scrim material which serves to reinforce the fabric. Typically, scrim consists of an open mesh of continuous filaments or yarns running both in the machine direction (length) and the cross machine direction (width) of the web. The filaments or yarns may be of any suitable material that is compatible with the nonwoven material to which the scrim is laminated. The continuous filaments of the scrim material impart the requisite tensile strength to the nonwoven fabric both in the machine direction and the cross machine direction.

Wipers or other sheet products manufactured from scrim-reinforced material typically are dispensed either from a roll or a box with a top opening. The individual sheets on a roll are torn from the roll one at a time along perforation lines. Alternatively, the individual sheets may be packed in a box in interfolded fashion. The interfolded individual sheets are dispensed from the top opening one at a time in the manner of the well-known Kleenex brand facial tissues. When the sheets are interfolded into a box, it is still necessary for the sheets to be attached to each other along a line of perforation so that as one sheet is pulled from the box, it will pull the next sheet into position to be subsequently dispensed from the box as it separates from the next sheet.

In either case, whether the sheets are dispensed from a roll by tearing one sheet directly from the next or from an interfolded stack in a box, it is still necessary to perforate the web to assure the proper tearing characteristics along the line of perforation.

Conventionally, perforation of a web has been accomplished by a single knife having notches at regular intervals along its length. Consequently, the knife produces a discontinuous cut with the notches creating uncut bonding points or portions along the width of the web that hold the individual sheets together until it is desired that the individual sheets be torn apart. By varying the width of the notches, and therefore the width of unsevered material or bonding points, the amount of tear strength at the perforation can be adjusted to provide suitable separation characteristics for the individual sheets made from a particular fabric.

In the case of scrim-reinforced material, the conventional single knife with notches may not provide a perforation which will be suitable. For example, if one of the machine direction filaments or yarns of the scrim falls within the width of the notch of the knife, that filament or yarn will not be severed and will provide a very strong bond point between the individual sheets which not only will remarkably change the tearing characteristics between the two sheets, but in the extreme may make it virtually impossible to separate the individual sheets without damaging the sheets at other points where the sheet is being grasped and pulled.

The problem of unsevered machine direction filaments or yarns in scrim-reinforced webs is recognized in Lewyckyj patents Nos. 3,716,132 and 3,835,754. Particularly, the Lewyckyj patents note that the uncut threads or filaments in the machine direction are an "impediment to separation along the lines of perforations [and] may result in a tearing of the body of the sheet to be separated." In addition, the unsevered machine direction filaments may result in an "application of a force to separate a sheet from the main roll [which] may result in an unwinding of the roll rather than the desired separation." (Lewyckyj patent No. 3,716,132, col. 1, lines 50–55.) In order to overcome that problem, Lewyckyj proposes applying a crushing force to the laminated product in the region of the reinforcing filaments which will substantially reduce the tensile strength of the reinforcing threads without substantially affecting the integrity of the cellulosic wadding which is laminated to the scrim-reinforcement. The crushing force is applied to the laminate structure prior to the perforation.

SUMMARY OF THE INVENTION

It is, however, an object of the present invention to provide means for perforating a scrim-reinforced web to assure that no machine direction filaments or yarns remain unsevered and thereby assure that the individual sheets of the web are separable by application of a consistent tearing force.

It is likewise an object of the present invention to provide a means for perforating a scrim-reinforced web which provides three control variables at each bond point to control the degree of bonding between the individual sheets and the amount of tearing force required to separate individual sheets.

The above-identified objects of the present invention are accomplished by providing a scrim-reinforced web divided into individual sheets by a primary perforation pattern and a secondary perforation pattern which are parallel to each other and separated from each other along the length of the web. The perforation patterns each have alternating severed portions and unsevered portions. The severed portions of the primary perforation pattern align in the machine direction with the unsevered portions of the secondary perforation pattern, and the unsevered portions of the primary perforation pattern align in the machine direction with the severed portions of the secondary perforation pattern to assure all machine direction scrim filaments are severed.

The scrim-reinforced web of the present invention is perforated by a dual parallel knife arrangement in which a primary knife has a number of notches in its blade at predetermined intervals in the cross machine direction of the web, and a secondary knife lies parallel to and spaced from the primary knife and has tabs or blades which align with and extend across the width of the notches of the primary knife.

Also, the bond point between the individual sheets can be varied in three ways to control strength of the bonding point. First, the width of the unsevered portions of the primary perforation pattern can be varied. Second, the width of the overlap between the severed portions of the secondary perforation pattern and the severed portions of the primary perforation pattern can be increased or decreased. Third, the distance of separation between the two perforation patterns can be varied.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
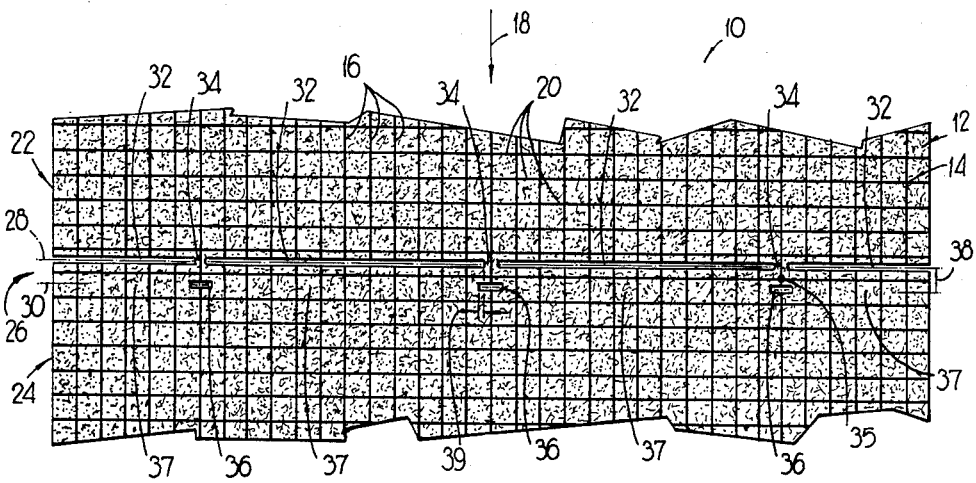
FIG. 1 is a top plan view of a scrim-reinforced web (with the top nonwoven or tissue layer removed) showing a perforation pattern and made in accordance with the present invention.

Turning to FIG. 1, there is shown a scrim-reinforced material or fabric 10 of the present invention. The fabric consists of a lower nonwoven layer 12 laminated to an open mesh scrim 14. The fabric 10 has a top layer of nonwoven material, similar to the bottom layer 12, which has been removed in FIG. 1 in order to show the reinforcing scrim 14.

The reinforcing scrim 14 includes filaments or yarns, such as 16, running in the machine direction (length) of the web as indicated by arrow 18. In addition, the scrim 14 also includes filaments, such as 20, which run in the cross machine direction (width) of the web 10. The scrim 14 with its machine direction filaments 16 and cross machine direction filaments 20 provide the nonwoven material 12 (including top layer not shown) with additional tensile strength in both the machine and cross machine directions.

With continuing reference to FIG. 1, the web 10 may be divided into two or more individual sheets such as sheets 22 and 24. The boundary between the individual sheets 22 and 24 is defined by a perforation pattern extending across the width of the web and generally indicated at 26. The perforation pattern 26 comprises two parallel perforation patterns, a primary perforation pattern 28 and a secondary perforation pattern 30 separated by a distance 38. The primary perforation pattern 28 includes perforations 32 across the web separated by unsevered primary bond portions 34. The secondary perforation pattern 30 includes perforations 36 separated by unsevered secondary bond portions 37. The perforations 32 of the primary perforation pattern and 36 of the secondary perforation pattern both extend through the full thickness of the web 10.

The secondary perforations 36 are spaced a distance 38 in the machine direction from the primary bond portions 34. Moreover, the perforations 36 are wider than the primary bond portions 34 in the cross machine direction to assure an overlap 39 of the perforations 32 and 36 in the cross machine direction. Consequently, as can be seen in FIG. 1, there are no machine direction filaments, such as filament 16, which have not been severed by a perforation, either 32 or 36. As a result, the individual sheets 22 and 24 are held together by the nonwoven material 12 which at the primary bond portions 34 has predictable tearing characteristics. In addition, when the cross machine filaments fall between the primary and secondary perforation patterns 28 and 30 (about 5% of the time), the sheets 22 and 24 are also held together by the weak bonds, such as 35, between the machine and cross machine filaments of the scrim 14.

The two parallel perforation patterns 28 and 30 provide flexibility in establishing the tear characteristics of the primary bond portions 34 and therefore between sheets 22 and 24 of web 10. First, the bond portion characteristics can be varied by varying the width of the unsevered primary bond portion 34 between perforations 32 of the primary perforation pattern 28. Second, the characteristics of the primary bond portion 34 can be varied by varying the distance 38 between the parallel perforation patterns 28 and 30 in the machine direction. Third, the characteristics of the primary bond portion 34 can be varied by varying the amount of overlap 39 between perforations 36 and perforations 32.

Figure 3:
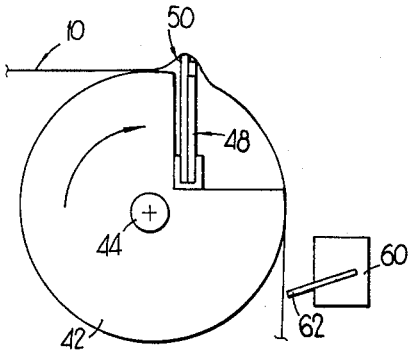
FIG. 3 is a side elevation view of the rotary shear including the dual perforation knife assembly with the knives engaging the web prior to shearing.

Turning to FIG. 3, there is shown a rotary shear 40 which may be used to produce the dual perforation pattern 26 for perforating scrim-reinforced web of the present invention. The rotary shear is illustrative of one means for providing the dual perforation pattern 26 described in connection with FIG. 1. It would be apparent to a person of ordinary skill in the art that the dual perforation pattern of the present invention may also be implemented by using other cutting methods.

Figure 5:
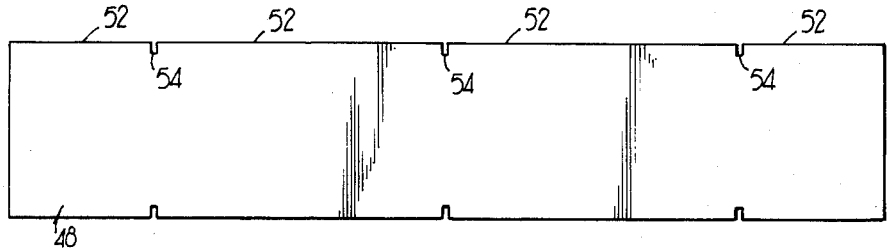
FIG. 5 is a side elevation view of a primary knife used in connection with the present invention.
Figure 6:
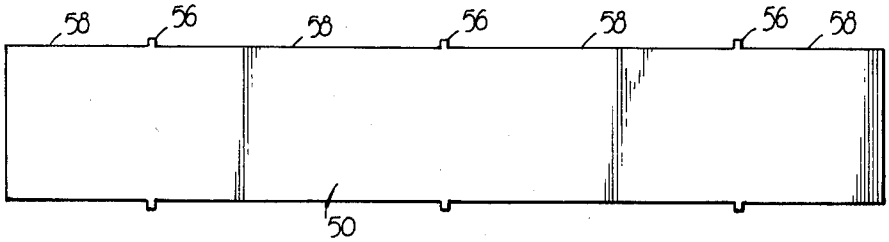
FIG. 6 is a side elevation view of a secondary knife used in connection with the present invention.

The rotary shear 40 includes a drum 42 mounted on an axis 44 for rotation. The drum 42 has a knife holder 46 mounted within the circumference of the drum. The knife holder 46 is used to secure primary knife 48 and secondary knife 50 to the drum 42 for rotation therewith. The knives 48 and 50 are positioned to protrude above the circumference of the drum 42. Primary knife 48, which is shown in FIG. 5, includes sharpened blade portions 52 with notches 54 separating the blade portions. The secondary knife 50 has blade or tab portions 56 separated by large notches 58. As shown in FIGS. 5 and 6, the blades 48 and 50 are reversible so that after one edge has become dull, the blades are simply reversed, either turned front to back or turned end to end, in the blade holder 46 to provide one of four fresh edges for cutting.

Figure 2:
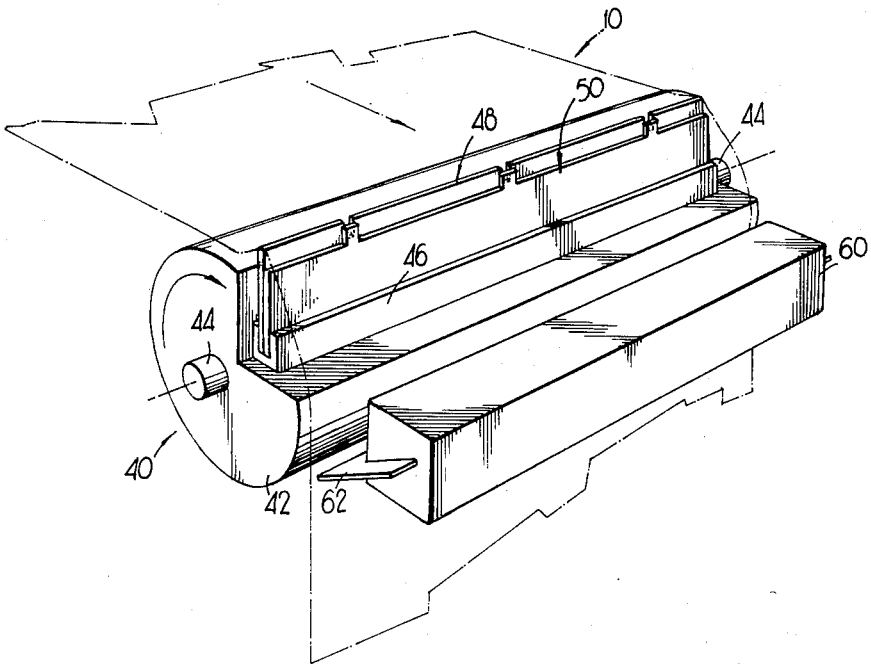
FIG. 2 is a perspective view of a rotary shear which includes a dual perforation knife assembly to carry out the present invention.
Figure 4:
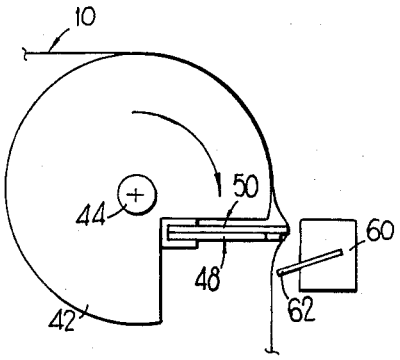
FIG. 4 is similar to FIG. 3 but shows the dual perforation knife assembly as it completes perforation of a scrim-reinforced web.

Returning to FIG. 2, a shear anvil block 60 is mounted adjacent the drum 42. The anvil block 60 includes a shear edge 62 which extends across the width of the shearing block 60 and in a slightly helical fashion. As can best be seen in FIG. 3, the web 10 passes over the drum 42 and over the extending primary and secondary blades 48 and 50. As the drum rotates into the position shown in FIG. 4, the primary and secondary blades 48 and 50 engage the shear blade 62 of the anvil block 60. Consequently, the blades penetrate the full depth of the web 10 producing the perforation patterns 28 and 30 shown in FIG. 1. As the drum 42 rotates, the knives 48 and 50 engage the web 10 again at a distance equal to the circumference of the drum 42 to create a second dual perforation pattern 28 and 30 to separate the individual sheets one from the other.

I claim:

1. A scrim-reinforced web having a length and width which web comprises nonwoven material or tissue laminated to a scrim material having filaments running the length and width of the web and wherein the web is divided into individual sheets by a perforation pattern having a primary perforation pattern extending across the width of the web and having alternating primary perforations and unsevered primary bond portions, and a secondary perforation pattern spaced lengthwise from the primary perforation pattern and having alternating secondary unsevered bond portions and secondary perforations, which secondary perforations align with the unsevered primary bond portions of the primary perforation pattern and overlap a part of the primary perforations along the width of the web.

* * * * *